United States Patent [19]

Clarke

[11] 4,076,097

[45] Feb. 28, 1978

[54] AUGMENTED PASSIVE RADIATOR LOUDSPEAKER

[76] Inventor: Thomas Lowe Clarke, 12110 SW. 108 St., Miami, Fla. 33186

[21] Appl. No.: 711,570

[22] Filed: Aug. 4, 1976

[51] Int. Cl.[2] ..... H04R 1/02

[52] U.S. Cl. ..... 181/147; 181/156

[58] Field of Search ..... 179/1 E, 116; 181/144, 181/145, 146, 147, 148, 149, 150, 151, 152, 153, 154, 155, 156, 157, 160, 163, 164, 165, 199

[56] References Cited

U.S. PATENT DOCUMENTS

| | | | |
|---|---|---|---|
| 3,772,466 | 11/1973 | Hossbach | 179/116 |
| 3,780,824 | 12/1973 | Prince | 181/144 |

*Primary Examiner*—George G. Stellar

[57] ABSTRACT

A resonant loudspeaker system which produces improved reproduction of low frequency sound comprises a coupling chamber which encloses the rear of the low frequency driver and which contains two additional openings in which are suspended diaphrams free to move but coupled together so that the forces on them are in opposition. One of the diaphrams is baffled and the other is free to radiate. The air in the coupling chamber when excited by the low frequency driver can only act upon the difference in the areas of the diaphrams, but the radiation produced by the diaphrams is determined by the unbaffled area. The radiation from the rear of the low frequency driver is thus amplified permitting an improved combination of low frequency response, low distortion, electrical efficiency and physical size to be achieved.

3 Claims, 4 Drawing Figures

AUGMENTED PASSIVE RADIATOR LOUDSPEAKER

BACKGROUND

1. Field

This invention relates to devices for the high quality reproduction of sound and particularly to those that use a resonant enclosure to allow the rear radiation of the driver to reinforce the direct radiation at low frequencies.

2. Description of Prior Art

Two considerations dominate the design of a loudspeaker required to accurately reproduce low frequencies. A large amount of air must be displaced by the motion of the speaker cone, and the pressure field produced by the displacement of the rear of loudspeaker must not be allowed to cancel that produced by the front. In addition the loudspeaker cone exhibits a mass and its suspension exhibits a compliance. These together determine a resonant frequency below which the sound output drops rapidly.

A common solution is to use a loudspeaker sufficient in size to displace enough air and to mount it in a closed box so that front to rear cancellation cannot occur. The compliance of the air in the box raises the resonant frequency of the speaker so that if a desirably low response is to be maintained, either a large box must be used, or the mass of the speaker cone must be increased. If the mass of the speaker is increased, the efficiency of conversion of electrical to acoustic energy will be lowered.

Many designs use the pressure field produced by the rear of the loudspeaker to enhance the low frequency response through various arrangements of resonators, ducts or horns. Those using ducts or horns are not directly related to this invention, although the rear horn loaded type exhibits many of the desirable properties of this invention, but at some cost in size and complexity (Hancock, 1975, U.S. Pat. No. 3,923,124).

Most directly related to this invention are those speaker systems which turn the closed box into a resonator by providing a mass loaded opening in the enclosure. The mass associated with the opening resonates with the compliance of the air in the box in such a way that when the resonator is excited by the motion of the rear of the loudspeaker cone the pressure field emitted through the opening is in phase with that produced by the front of the loudspeaker and cancellation does not occur. Thus both sides of the speaker do useful work and the efficiency of the loudspeaker is increased. For a general discussion of resonator or bass reflex enclosures see L. L. Beranek, *Acoustics,* McGraw-Hill, 1954.

The mass loading of the opening can be produced by the acoustic mass associated with the opening. This acoustic mass may also be augmented by the use of a duct. Alternately, the mass can be produced by a tangible diaphram flexibly suspended in the opening. In this case there is an additional compliance associated with the suspension of this passive radiator, but operation is substanially the same as with acoustic loading (H. F. Olson, 1935, U.S. Pat. No. 1,988,250).

A resonant enclosure loudspeaker can produce useful sound output down to the free-air resonant frequency of the speaker. This requires, however, an enclosure with compliance at least as large as that of the speaker alone. For a practical speaker large enough to reproduce low frequencies the enclosure required is quite sizable. If the enclosure size is reduced either the low frequency response or the efficiency must suffer. Thus good bass response with a speaker large enough to insure low distortion and good efficiency of conversion of electrical to acoustic energy has heretofore required a relatively large enclosre.

The invention disclosed herein is an improved form of resonant enclosure which is of smaller size than previous designs for a given combination of distortion, frequency response and efficiency.

SUMMARY OF THE INVENTION

This invention consists of a coupling chamber which encloses the rear of the loudspeaker or loudspeakers and has two or more additional openings communicating with the surrounding air. Two diaphrams are flexibly suspended across the openings and are coupled together so that the forces on the diaphrams produced by the acoustic pressure in the chamber are in opposition. For best results the two openings will be of unequal area and the larger will be free to radiate while the smaller is baffled. This baffle may be a closed box, an open box placed near a wall or any baffle which serves to prevent the radiation from the diaphram suspended in the baffled opening from cancelling that of the diaphram free to radiate.

The compliance of the air in the coupling chamber, the mass of the diaphrams, the compliance of their suspensions, and, if sealed, the compliance of the air in the baffle comprise a tuned circuit. This tuned circuit, when properly adjusted, causes the motion of the diaphrams to be in phase with the motion of the speaker over the critical low frequency region. The air in the coupling chamber, when excited by the rear of the loudspeaker, can only produce a net effect upon the difference of the areas of the diaphrams. The magnitude of diaphram motion is thus determined by the difference in areas while the amount of reinforcing radiation is determined by the area of the unbaffled diaphram. At low frequencies the radiation from the rear of the loudspeaker is amplified by the ratio of the unbaffled area to the difference in areas.

The advantage of this invention over previous resonant enclosures lies in the increased radiation derived from the rear of the loudspeaker at low frequencies. This allows the use of a coupling chamber much smaller than a conventional resonant enclosure. The smaller coupling chamber produces increased loading on the rear of the loudspeaker, reducing its motion at low frequencies. This reduced motion allows the use of a smaller loudspeaker which allows additional reduction in coupling chamber size. The enclosure used to baffle one of the diaphrams does not have to be large even if its is a sealed box. The mass of the diaphrams provide partial cancellation of the enclosure compliance at the resonant frequency. The low frequency performance of a speaker equal in size to the radiating diaphram can be obtained in a smaller enclosure than otherwise possible.

The small low frequency speaker made possible by this invention is also better able to reproduce the middle range of frequencies than the large speaker otherwise required. In some applications a separate midrange speaker may be eliminated with no sacrifice in performance.

This invention exhibits smoother response below the resonant frequency than a conventional resonant enclosure. In a resonant enclosure, the sound derived from the rear of the loudspeaker tends to become more out of phase with that from the speaker below resonance, producing a rapid drop off in sound output. In this invention the radiating diaphram radiates more than the speaker so that the drop off below resonance is more gradual. This smoother drop off contributes to the improved transient response exhibited by this invention.

DESCRIPTION OF PREFERRED EMBODIMENT

Figure 1:
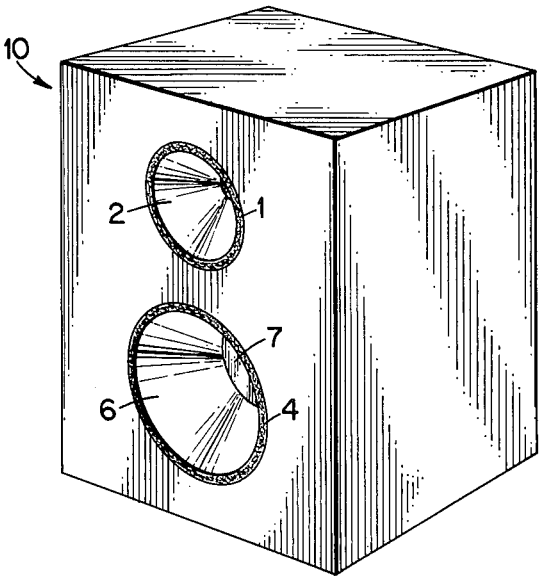
FIG. 1 is a perspective view of a loudspeaker system embodying the present invention.
Figure 2:
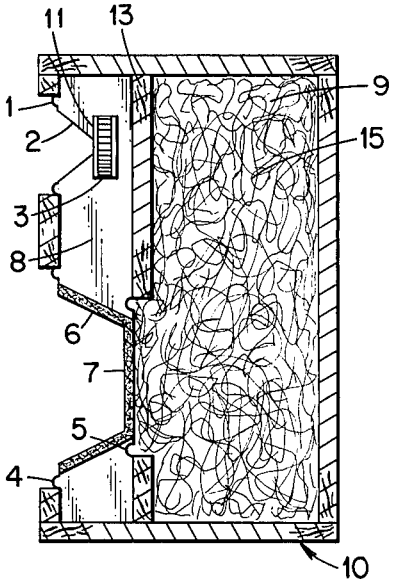
FIG. 2 is a vertical section through the speaker system of FIG. 1 showing the speaker driver, the two coupled diaphrams, the coupling chamber and the baffle.

FIG. 1 is a perspective view of the preferred embodiment of the present invention. FIG. 2 is a vertical cross section showing more detail of the same embodiment. A rectangular box 10 has mounted in an opening on its front surface a speaker 11 which has a cone 2 driven by magnetic structure 3 and which is suspended by suspension 1. The box is divided into a coupling chamber 8 and an enclosure 9 by a vertical partition 13. The box and partition are made from particle board, although any other suitably rigid material will do. The radiating diaphram is composed of conical diaphram 6 together with flat diaphram 7. The baffled diaphram is the flat diaphram 7. These diaphrams are made from polystyrene foam although other materials are suitable. They are suspended in the openings in the coupling chamber 8 by suspensions 4 and 5 formed from thin plastic foam or other suitable material. The enclosure 9 is filled with acoustic insulating material 15 to provide damping for the diaphram 7 and to increase the effective volume of enclosure 9 by conversion of adiabiatic to isothermal expansion.

The components of this embodiment were adjusted so that the compliance of the coupling chamber 8 acting on cone 2 was half that of the speaker suspension 1. The compliance of enclosure 9 acting on diaphram 7 was equal to that of chamber 8 acting on cone 2. The difference in areas of the two diaphrams which equals the projected area of cone 6 was made equal to that of cone 2. The area of the radiating diaphram was three times that of cone 2, making the ratio of total area to difference in area three. The total mass of diaphrams 6 and 7 was made four times that of cone 2. A 6½ inch driver with effective diameter of 5 inches and mass of 13 grams was used. The diameter of flat diaphram 7 was 7 inches and the outer diameter of conical diaphram 6 was 8½ inches. The mass of 6 and 7 combined was 52 grams. The coupling chamber 8 has volume ½ $ft^3$ and enclosure 9 has volume 1½ $ft^3$ for a total box volume of 2 $ft^3$. The most critical alignment parameter is the ratio of the speaker cone mass to the mass of the diaphrams. The free air resonance of the speaker was 30 Hz and the speaker mounted in this enclosure has a response down to 30 Hz with a gradual drop off below this frequency.

A convenient way to understand the operation of this embodiment is to realize that speaker 11, coupling chamber 8 and annular cone 6 comprise a conventional passive radiator enclosure. Diaphram 7, however, shares the motion of diaphram 6 and since its rear is enclosed by enclosure 9 radiates additional sound energy. Thus, the sound radiated by the rear of the loudspeaker is used to produce much more sound than is possible in a conventional resonant enclosure at the important low frequencies.

Another, more fruitful, way to view the operation of this embodiment is to consider that conical diaphram 6 and flat diaphram 7 comprise a front diaphram suspended in the front opening of the coupling chamber 8. Flat diaphram 7 is a rear diaphram suspended in the rear opening of the coupling chamber 8 and the front and rear diaphrams are coupled together by the material of flat diaphram 7. If the front and rear, conceptually separate, diaphrams not coupled to each other, the two diaphrams, coupling chamber and driver, would comprise a conventional passive radiator loudspeaker. A positive acoustic pressure of the air in the coupling chamber tends to push the front diaphram to the left and the rear diaphram to the right. When the two diaphrams are coupled the forces on the front and rear diaphram are placed in opposition so that the net displacement of the composite diaphram is toward the front since the front diaphram has greater area. Thus for a given displacement of air by the driver the corresponding displacement of the composite diaphram will be greater than that of a simple diaphram, since only the difference in area of the two diaphrams, here the projected area of conical diaphram 6 can produce a compensatory displacement of air in the coupling chamber. The motion of the composite diaphram will thus be greater than the motion of a conventional passive radiator diaphram of the same area producing greater sound radiation in the critical low frequency region.

Figure 3:
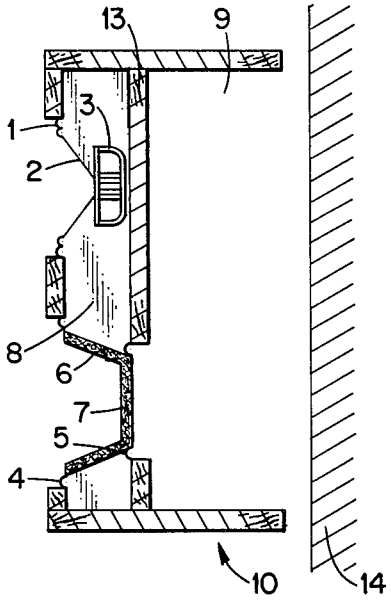
FIG. 3 is a vertical section through a speaker system embodying this invention, but using an open backed baffle.

FIG. 3 illustrates how this invention might be useful in conjunction with an open back loudspeaker such as might be used in a console. In this case the enclosure 9 has no back but is normally placed near a wall 14 to maximize the net sound radiation from diaphrams 6 and 7.

Figure 4:
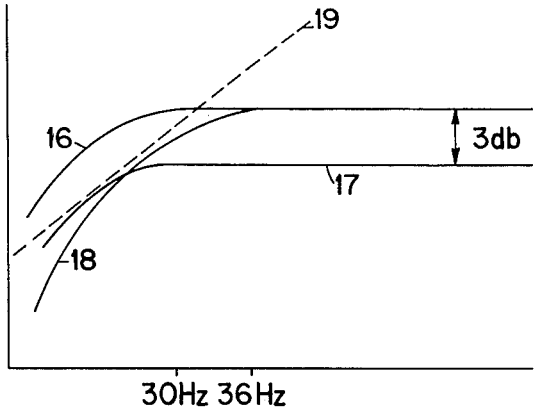
FIG. 4 is a graph of sound output versus frequency showing the advantage of this invention over conventional enclosures.

For comparison with conventional resonant enclosures FIG. 4 shows the response of this invention 16 and the response of a conventional enclosure of the same volume using a larger speaker 10 inches in diameter to achieve the same low distortion. The same magnet structure is used in the 10 inch speaker as is used in the 6½ inch speaker in the above embodiment. In curve 17 the conventional design has been adjusted for comparable response, but exhibits lower efficiency. Curve 18 is for a conventional system adjusted for the same efficiency; it has a higher frequency cut off. Thus combinations of response and efficiency which fall above line 19 are impossible for a conventional system without increasing its size, magnet weight or distortion.

No details of separate midrange or high frequency drivers have been included in this embodiment. Such drivers would normally be used in a high quality loudspeaker system and their omission here is not meant to be restrictive of this invention. The enclosure forms and diaphram shapes presented here are meant to be illustrative and not restrictive of this invention. The essential principle is the use of a coupling chamber together with two or more diaphrams arranged so that the air in the coupling chamber acts only on a portion of the total area of the diaphrams. One of the diaphrams is free to radiate and the other may be baffled so that improved utilization of the rear radiation of the loudspeaker is accomplished.

I claim the following as my invention:

1. A loudspeaker system comprising an enclosed chamber having an energized driver mounted in a first opening, two diaphrams suspended in second and third openings, said diaphrams being interconnected so that an outward motion of one produces an inward motion of the other.

2. A loudspeaker system comprising an enclosed chamber having an energized driver mounted in a first opening, and second and third openings disposed in substantially parallel planes, an auxiliary radiator comprising a diaphram surface suspended in each of said second and third openings, said diaphram surfaces being rigidly interconnected.

3. A loudspeaker system comprising an enclosed chamber having a predetermined front surface, and a predetermined rear surface, said front surface having two openings and said rear surface having one opening, an energized driver mounted in one of the front openings so that the rear of the driver radiates into the chamber, two auxiliary diaphrams, means suspending one of said diaphrams in the other front opening, and means suspending the other diaphram in the rear opening, means rigidly interconnecting the two auxiliary diaphrams.

* * * * *